United States Patent [19]

Ribbert

[11] 4,335,868

[45] Jun. 22, 1982

[54] DEVICE ADAPTED TO AFFORD PROTECTION AGAINST FALLING ROCKS AND AVALANCHES IN MOUNTAINOUS TERRAIN

[76] Inventor: Hans Ribbert, Unterheufeld 11, 8202 Bad Aibling, Fed. Rep. of Germany

[21] Appl. No.: 137,116

[22] Filed: Apr. 2, 1980

[30] Foreign Application Priority Data

Mar. 15, 1979 [DE] Fed. Rep. of Germany ..... 2910239

[51] Int. Cl.[3] ..... E01F 7/00

[52] U.S. Cl. ..... 256/1; 256/12.5; 135/7.1 R

[58] Field of Search ..... 256/1, 12.5, 23, 24; 135/7.1 R

[56] References Cited

U.S. PATENT DOCUMENTS

| | | | |
|---|---|---|---|
| 2,134,624 | 10/1938 | Royall | 256/1 |
| 3,042,053 | 7/1962 | Gabriel | 135/7.1 R |
| 3,480,023 | 11/1969 | McConnell et al. | 135/7.1 R |
| 4,096,874 | 6/1978 | Weatherly | 135/7.1 R |

FOREIGN PATENT DOCUMENTS

| | | | |
|---|---|---|---|
| 224254 | 6/1959 | Australia | 256/24 |
| 1071738 | 12/1959 | Fed. Rep. of Germany | 256/12.5 |
| 643865 | 5/1928 | France | 256/12.5 |
| 580285 | 7/1958 | Italy | 256/12.5 |
| 1303218 | 1/1973 | United Kingdom | 256/12.5 |

*Primary Examiner*—James Kee Chi

*Attorney, Agent, or Firm*—Wegner, McCord, Wood & Dalton

[57] ABSTRACT

The leg portions of metallic yokes which are substantially bent to U-shape comprise free ends adapted to be anchored in the ground, the said leg portions being substantially arranged one behind the other along the line of slope of a hill flank. Mutually adjacent yoke members of the device are interconnected by means of a wire cable which is preferably attached to the curved bights of the yoke members. Additional connecting means disposed between individual, mutually spaced yoke members form intercepting nets bearing against that side of said leg portions which faces the hill flank, said nets being connected to said yoke members, and serving to intercept falling rocks or snow. An important feature of such devices which is of particular importance where such devices are employed in mountainous terrain, resides in the fact that they can be easily transported and can be anchored in the ground in a simple manner. Another advantage of said devices resides in the fact that they are adapted to be deformed elastically upon being impacted by falling rocks or avalanches so as to dissipate the kinetic energy of such material without themselves being destroyed.

10 Claims, 6 Drawing Figures

DEVICE ADAPTED TO AFFORD PROTECTION AGAINST FALLING ROCKS AND AVALANCHES IN MOUNTAINOUS TERRAIN

FIELD OF THE INVENTION

This invention relates to a device for use in mountainous terrain adapted to afford protection against falling rocks and avalanches, said device being provided with supporting members which are adapted to be connected to securing means provided in the ground, at least two such supporting members being connected together.

DESCRIPTION OF THE PRIOR ART

In mountainous terrain it has been conventional to employ frame- or trestle-like structures for the purpose of protecting areas at lower elevations against falling rocks and/or avalanches. Where it is difficult to obtain access to such terrain, said structures are transported to the contemplated site by means of helicopters. Such known structures comprise supporting beams which are disposed at an angle in relation to the sloping hill flank, and which are supported by supporting members extending downhill at a angle. The former supporting members or beams are interconnected by a grid structure. In addition, said supporting beams and said supporting members are connected to the sloping hill flank by means of a strong foundation. For each supporting beam and the associated supporting member it is necessary to construct the required foundation in situ. This requires the expenditure of considerable labor and the transportation of rock drills and the like to the site. The disadvantages of this known device include the fact that it is necessary to transport to the construction site such items as heavy-weight construction elements, machinery and construction materials, particularly concrete. For the purpose of preparing the foundations for the supporting beams and the supporting elements it is necessary to employ rock drills for the preparation of amply dimensioned holes which are later on filled with concrete forming the desired foundation. Thus, the employment of this known device leads to considerable expense.

There have also been known devices of lighter construction for providing protection against avalanches and falling rocks. Such a device comprises poles or rails which are disposed in the sloping hill flank at suitable intervals and are interconnected by means of a network or grating structure. In this case, too, the said poles or rails are held in position by foundations which are prepared in the aforeindicated manner. While these known devices are of lighter weight than the known devices mentioned earlier, they suffer from the disadvantage that they are not so effective as the first-mentioned devices. Also in this second case, the preparation of the concrete foundations is an expensive proposition.

Since the said poles, supporting members or supporting beams have to be securely anchored to the sloping hill, the preparation of concrete foundations is necessary where known devices of the two types mentioned are to be employed. In connection with this, the fact has also to be taken into consideration that the consistency and the load-bearing capacity of the soil is not uniform. Another point to be considered is the fact that in mountainous terrain the rock material and the soil are subject to constant weathering. In order to ensure full efficiency of the device to be employed, the foundations to be prepared should extend into the soil to the maximum possible depth, even below the frost line. It will be understood that such foundations are extremely expensive.

In view of the above, it is an object of the present invention to provide a device of the type indicated earlier which is of considerably lighter weight than the said conventional devices and which comprises securing means which are of considerably less complicated design than in the case of said known devices.

SUMMARY OF THE INVENTION

According to the present invention, this object is attained by the provision of a device of the aforeindicated type in which each supporting member is constituted by a generally U-shaped member which comprises two leg sections which are interconnected by a curved bight section, the said device being adapted to be attached to securing means provided in the terrain, and each device comprising at least two co-operating U-shaped members provided with a catching net formed by at least one covering means or plank arrangement.

One of the advantages afforded by the present invention resides in the fact that it is sufficient to provide particularly simple and light-weight supporting members which, in co-operation with the said covering means forming a catching net or with the said plank arrangement, afford effective protection against falling rocks and avalanches in mountainous terrain, and, in addition, the devices of the invention are adapted to be attached to securing means of particularly simple construction provided in the terrain. Such securing means may, for example, be formed by simple drill holes into which the leg portions of said U-shaped members may be inserted in a most simple manner. An important feature of the inventive device resides in the fact that it is not necessary to provide expensive foundations serving to receive the U-shaped members.

According to the invention it is convenient to employ pairs of U-shaped members of which the curved bight portions are rigidly interconnected. This arrangement affords the advantage that a device constructed in this manner is particularly suitable to provide protection against avalanches. Such interconnected U-shaped members need not be connected to corresponding additional members.

In another embodiment of the invention, the U-shaped members serving the function of adjacent supporting members are preferably provided, on at least their corresponding leg portions, with continuous covering means or rock or snow catching planks. The device of the invention affords protection against falling rocks and avalanches in a particularly advantageous way since it is possible to arrange the said U-shaped members on a hill slope in such a manner that their main planes extend in a downhill direction.

In another preferred embodiment of a device according to the invention for affording protection against falling rocks and avalanches two U-shaped members employed as adjacent supporting members are provided on all of their leg portions with continuous covering means or continuous planks, and each U-shaped member is provided with a supporting yoke extending away from it at right angles to the main plane. In this manner there is obtained a particularly stable device affording protection against falling rocks and avalanches, it being admitted that the employment of one supporting yoke for each supporting member leads to a slight increase in cost. In the latter case, the said supporting yokes are adapted, in the same manner as the leg portions of said supporting members, to be attached to securing means provided on the hillside, said securing means being formed by simple drill holes. The device comprising the supporting yokes just described is employed in mountainous terrain in such a manner that the openings formed by the supporting yokes face the expected source of falling rocks or an avalanche, respectively, that is to say that the supporting yokes extend transversely of the downhill direction.

In the case of the device described earlier the supporting yokes of all U-shaped members are preferably provided with continuous covering materials or intercepting planks. As will be detailed below, this type of structure affords a particularly effective protection against falling rocks and avalanches.

Adjacent U-shaped members are suitably interconnected by means of a metallic cable which is, in turn, connected to each U-shaped member. In this manner a particularly stable and rugged device is obtained. In addition, this arrangement gives substantial assurance that no supporting yoke can be lost should it have become detached from its securing means.

The said covering material or intercepting planks are preferably provided on that side of the supporting yokes which faces the expected source of falling rocks or avalanches. In this manner particularly effective protection against falling rocks and avalanches is obtained.

The said supporting yokes have their ends preferably formed in such a manner that they are adapted to be exchangeably received by shank members belonging to the associated securing means. This arrangement makes it possible in a particularly simple manner to replace any desired supporting yoke should this become necessary. The said securing means may be constituted by simple drill holes in which the associated shank members are anchored by means of mortar.

Each U-shaped member preferably comprises a bent pipe section. This affords the advantage that these members are of low weight.

Each pipe section is preferably made of metal so as to provide particularly high strength in a desirable manner.

BRIEF DESCRIPTION OF THE DRAWINGS

Further features of the object of the invention will be understood from the following description, reference being had to the drawings.

DETAILED DESCRIPTION OF THE PREFERRED EMBODIMENT

Figure 1:
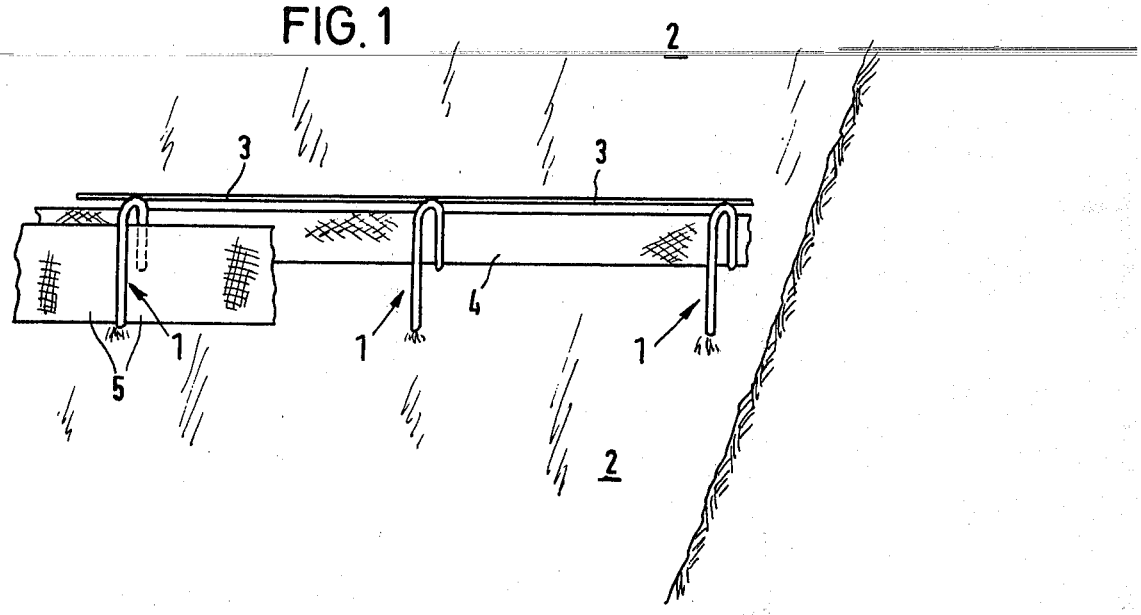
FIG. 1 is a perspective view of a first embodiment of a device according to the invention.
Figure 2:
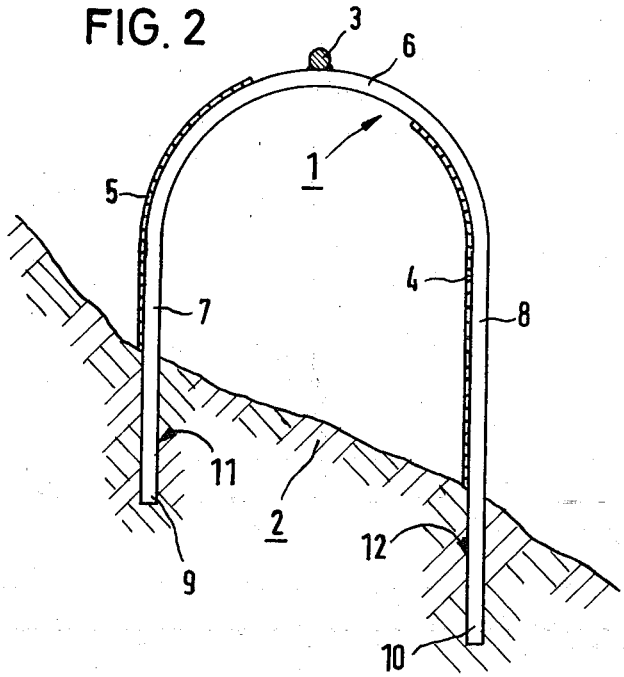
FIG. 2 is an enlarged cross-sectional view of a U-shaped member forming part of the device of FIG. 1.
Figure 3:
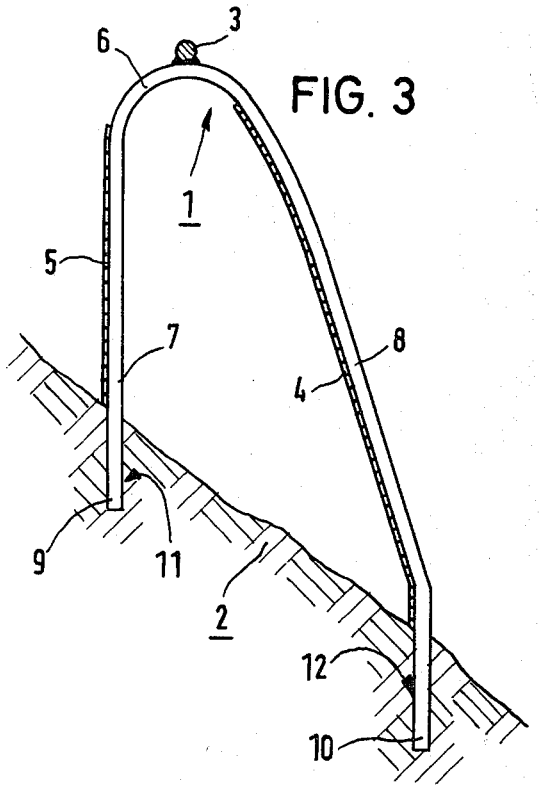
FIG. 3 is an enlarged cross-sectional view of a modified embodiment of the U-shaped member shown in FIG. 2.

Shown in FIG. 1 is a first embodiment of a device according to the invention, said device comprising spaced U-shaped members 1, each of which, as particularly shown in FIGS. 2 and 3, comprises a pair of leg portions which are interconnected by a bent bight portion. In the device of FIG. 1, the main plane of each U-shaped member defined by the two leg portions extends in the direction of the line of slope of a schematically indicated hill 2. The bent bight portions of the U-shaped members 1 are interconnected by means of a metallic cable 3 or any other connecting means. The U-shaped members are attached, by means of their leg portions, to securing means provided in the hillside 2, it being possible, as shown in FIGS. 2 and 3, to employ securing means in the form of simple holes drilled into the hillside 2.

As will be seen in FIG. 1, corresponding leg portions of the U-shaped members 1 are provided with continuous covering material. Thus, the leg portions of the U-shaped members 1 which are more nearly adjacent to the hill flank are provided with covering material 4, whereas the leg portions which are further removed from the hill flank are provided with covering material 5. The covering materials 4 and 5 or other suitable intercepting means are disposed on that side of the U-shaped members 1 which faces the expected source of falling rocks or avalanches, i.e. on that side of the leg portions of the U-shaped members 1 which faces the top of the hill flank. It should be understood that, as a matter of principle, it is sufficient to provide only one of the covering materials or nets shown in FIG. 1. However, the employment of two coverings or nets 4 and 5 will increase the extent to which the device is capable of dissipating or reducing the kinetic energy of material falling down the hill flank. In the latter case, the falling material will first elastically impact against the covering material which is more nearly adjacent to the hill flank, this resulting in a primary energy dissipation or reduction effect, whereupon the falling material may, under suitable conditions, impact against the covering material disposed at a slightly lower elevation so as to be intercepted by this covering material.

In order to secure the effect just described, the coverings or nets 4 and 5 are preferably attached to the leg portions of the U-shaped members in the manner shown in FIGS. 2 and 3. FIG. 2 illustrates a first possible shape of one of the U-shaped members 1. Such member comprises two leg portions 7 and 8 which are interconnected by a curved central bight portion 6. The leg portion 7 has its free end 9 received in a drill hole 11 provided in the hill flank 2. The free end 10 of the other leg portion 8 is received by a corresponding drill hole 12. The upper leg portion 7 of member 1 is provided with covering material or an intercepting net 5. The lower leg portion 8 of member 1 is provided with a covering or net 4. As shown in the drawing, the coverings or nets 4 and 5 attached to the leg portions 8 and 7 are of such vertical extent that there remains an aperture at the curved bight portion 6 as also seen in FIG. 1. This aperture is of particular advantage as regards the interception of falling material which may be thrown over the upper intercepting net 5; such falling material may pass said aperture and will then be intercepted by the covering or net 4. FIG. 2 also shows that the upper bight portion 6 of U-shaped member 1 is connected to a metallic cable 3, the attachment preferably being effected by means of clamps or wire winding. The U-shaped member 1 will preferably be made of metal.

FIG. 3 shows a modification of the U-shaped member 1 of FIG. 2. Those elements of the member shown in FIG. 3 which correspond to elements of the member of FIG. 2 are indicated by like reference numbers. In contrast to the U-shaped member of FIG. 2, the two leg portions 7 and 8 which are interconnected by a curved bight portion 6 are not mutually parallel but include a predetermined angle. However, the free end sections 9 and 10 of the leg portions 7 and 8 are parallel. In similarity to the U-shaped member shown in FIG. 2, the leg portions 7 and 8 of the U-shaped member of FIG. 3 have the coverings or nets 5 and 4 attached thereto in such a manner that an aperture remains in the region of the bight portion 6. In the same manner as shown in FIG. 2, the coverings or nets 5 and 4 are attached to the leg portions 7 and 8 in such a manner that their lower edges are practically in contact with the surface of hill flank 2. This arrangement makes it possible to have material directly rolling down hill flank 2 be intercepted by the respective devices.

Figure 4:
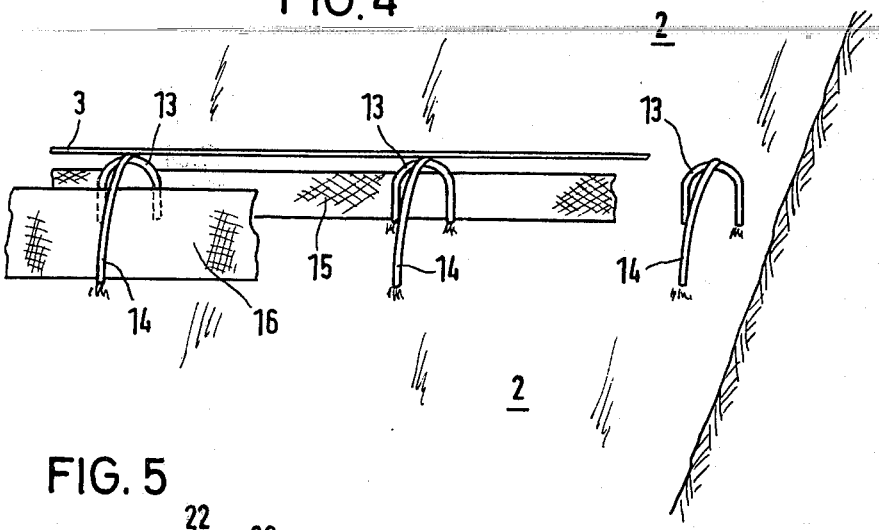
FIG. 4 is a perspective view of a second embodiment of a device according to the invention.

FIG. 4 shows a different embodiment of an inventive device. In contrast to the device of FIG. 1, adjacent U-shaped members 13 constituting the supporting members are disposed in such a manner that the planes defined by their leg portions extend transversely of the direction of slope of the hill flank 2. In addition, there extends from each U-shaped member 13 a supporting yoke 14 which faces in the downhill direction. The U-shaped members 13 and their supporting yokes 14 are anchored in the hill flank 2 in the same manner in which the U-shaped members 1 of the device of FIG. 1 are anchored.

The upper portions of the U-shaped members 13 shown in FIG. 4 are again interconnected by means of a wire cable 3 or other connecting means. In the device of FIG. 4, covering material 15 serving as an intercepting net is attached to the leg portions of each U-shaped member 13, which leg portions define a plane extending transversely of the line of slope of hill flank 2. The supporting yokes 14 are provided with a corresponding covering material 16. In similarity to the device of FIG. 1, these coverings or intercepting nets are made of continuous material, and they are arranged, according to FIG. 4, in such a manner that they define an elongated aperture. These coverings 15 and 16 are again arranged in such a manner that their lower edges are in contact with hill flank 2. As regards the said coverings or nets 15 and 16, it will be understood that they are arranged in the manner shown in FIG. 1 on the side of the leg portions of the U-shaped members 13 and the supporting legs 14, respectively, which faces the hill flank 2. The supporting yokes 14 are preferably formed as elastically deflected yoke members.

Figure 5:
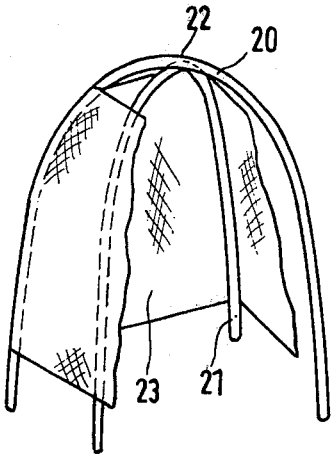
FIG. 5 is a partly broken-away perspective view of a third embodiment.

FIG. 5 illustrates still another embodiment of the invention. This device comprises only two U-shaped members 20 and 21 which are disposed in relation to one another in such a manner that their curved bight portions cross each other; at the crossing point 22 the two members are, if desired, rigidly interconnected. The area extending between at least two mutually adjacent leg portions of the two U-shaped members 20 and 21 is closed by means of covering material 23. The device of FIG. 5 is particularly suitable for the provision of protection against avalanches, it being understood that a plurality of similar devices will be sporadically distributed on hill flanks where avalanches have to be expected. The device of FIG. 5 may be anchored in the ground in the manner described with reference to FIG. 1.

As explained with reference to FIG. 1, the various embodiments of the inventive devices may be simply inserted into holes drilled into the ground. Such holes can be prepared at any desired places with the aid of tools of light weight; in addition, such holes may be filled with mortar in order to improve the stability of the devices to be held in position. No special foundation is required in this case since each device actually comes into action as a twin protective device, this meaning that the device need not absorb the entire kinetic energy of falling material being intercepted but the dissipation of this kinetic energy is practically effected in two phases.

Figure 6:
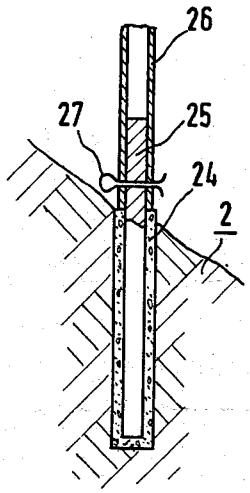
FIG. 6 is a partial cross-sectional view of an arrangement adapted to connect a U-shaped member to anchoring means.

It is convenient, however, to provide securing means permitting the device to be detachably anchored in the ground. A suitable arrangement serving this purpose is shown in FIG. 6. According to FIG. 6, there is provided in hill flank 2 a shank or rod member 25 which is received by a suitable drill hole which may be filled, for example, with mortar 24. One free end 26 of a leg portion of a U-shaped member or of a supporting yoke may be detachably connected to rod member 25. To permit this, the free end 26 is of tubular shape. For the purpose of interlocking the elements 25 and 26, there may be provided a cotter pin 27.

Finally it will be understood that in the inventive devices described the U-shaped members and the supporting yokes (where present) may preferably be constituted by bent pipe sections which are made of metal to afford the desired stability. The reduction in weight this shape affords in comparison to U-shaped members and supporting yokes made of solid material greatly facilitates transportation of the devices to the intended sites. Furthermore it should be understood that in the devices shown in FIGS. 1 to 4 the cables 3 (preferably wire cables), in addition to their described function of interconnecting mutually adjacent U-shaped members, are adapted to prevent drawing-together two adjacent U-shaped members by falling material. In order to afford additional protection against such displacement, it is convenient to anchor their ends in the ground. Also worth mentioning is the fact that it is possible, as a device according to the invention is being installed in the ground, after one free end of U-shaped member has been anchored in position, to attach to this free end a supporting frame for a drilling machine. In contrast to drilling yokes which would otherwise have to be constructed or made separately, this arrangement is frequently of great importance in the case of steep or inaccessible hill flanks, and it permits savings in cost. If possible, the free end of the U-shaped member just mentioned will preferably be anchored in a horizontal portion of the hill flank.

In the place of coverings formed as intercepting nets it is possible to provide planks (not shown) made of U-sections or the like, such planks being adapted, in cases in which they are subjected to particularly strong impacts by falling material, to deform elastically or even plastically in order to dissipate kinetic energy.

I claim:

1. A device adapted to afford protection against falling rocks and avalanche in mountainous terrain, comprising a plurality of supporting members adapted to be attachable to securing means provided in the terrain, at least two of said supporting members supporting a guard net or a guard plank arrangement, the individual supporting members being interconnected, characterized in that the supporting members are U-shaped curved bars, the end portions of whose legs can be sunk into securing means installed in the terrain and are hence secured.

2. A device according to claim 1 characterized in that the bars have tubular end portions, which can be attached to the shaft members anchored in the terrain.

3. A device according to claim 1 characterized in that the individual supporting members are interconnected with a cable means.

4. A device according to claim 1 characterized in that a covering arrangement is provided at the supporting members which undergoes an elastic or plastic deformation when intercepting falling material.

5. A device adapted to afford protection on sloped terrain against falling rocks and avalanches comprising:

a plurality of U-shaped members each having an uphill leg separated by a curved portion from a substantially parallel downhill leg, the free ends of said legs being slideably received into bores positioned in the terrain;

interconnecting means to connect the curved portions of at least two of said members;

a first covering disposed to intercept falling material, said first covering supported by said uphill legs of interconnected members; and a second covering supported by said downhill legs of said interconnected members, said second covering spaced from said first covering by said curved portion to intercept falling material deflected by or not intercepted by said first covering.

6. A device adapted to afford protection on sloped terrain against falling rocks and avalanches, comprising:

a plurality of support members each having a pair of substantially parallel legs adapted to be slideably received into the terrain, said legs upstanding from said terrain and supporting a curved portion therebetween;

means for interconnecting at least two of said support members at their curved portions; and covering means disposed to intercept falling material, said covering means covering only said legs of said interconnected support members.

7. The device described in claim 6 wherein said legs are tubular and rods are secured to said terrain, said rods being slideably received into said legs to secure said support member to the terrain.

8. The device described in claim 6 wherein said interconnecting means is a cable.

9. A device adapted to afford protection against falling rocks and avalanches comprising:

a plurality of U-shaped members each having a pair of substantially parallel legs adapted to be slideably received into bores in the terrain, said legs upstanding and spaced apart by a curved portion;

at least one other leg secured to the curved portion of said support member, said other leg extending away from the plane defined by said legs and said other leg having a free end substantially parallel to said legs for slideable reception into said terrain;

means for interconnecting the curved portions of at least two of said support members;

a first covering disposed to intercept falling material, said first covering secured to said legs; and a second covering disposed to intercept falling material, said second covering spaced from said first covering and supported by said yoke to, in cooperation with said first covering, insure interception of falling material.

10. The device described in claim 9 wherein said first covering is uphill of said second covering, said second covering intercepting falling material avoiding or deflected by said first covering.

* * * * *